US006113095A

United States Patent [19]

Naruse

[11] Patent Number: 6,113,095

[45] Date of Patent: Sep. 5, 2000

[54] BELT SUPPORTING DEVICE AND AUTOMATIC DOCUMENT FEEDING APPARATUS USING THE DEVICE

[75] Inventor: Haruo Naruse, Moriya-machi, Japan

[73] Assignee: Canon Kabushiki Kaisha, Tokyo, Japan

[21] Appl. No.: 09/121,682

[22] Filed: Jul. 24, 1998

[30] Foreign Application Priority Data

Jul. 28, 1997 [JP] Japan ..... 9-202023

[51] Int. Cl.[7] ..... B65H 43/04

[52] U.S. Cl. ..... 271/198; 271/264; 271/6; 271/4.05; 271/7; 271/10.06; 271/34; 198/860.1; 198/860.4

[58] Field of Search ..... 198/860.4, 861.1; 271/6, 4.05, 4.06, 4.09, 7, 12, 16, 10.06, 10.07, 10.01, 10.15, 34, 35, 264, 275, 198

[56] References Cited

U.S. PATENT DOCUMENTS

| | | | |
|---|---|---|---|
| 2,808,924 | 10/1957 | Wood | 198/208 |
| 3,870,140 | 3/1975 | Wieser | 198/190 |
| 4,993,542 | 2/1991 | Nomura | 198/816 |
| 5,004,223 | 4/1991 | Okui | 271/275 |

FOREIGN PATENT DOCUMENTS

| | | |
|---|---|---|
| 0548661 A1 | 6/1993 | European Pat. Off. . |
| 04020441 | 1/1992 | Japan . |

*Primary Examiner*—Donald P. Walsh
*Assistant Examiner*—David A Jones
*Attorney, Agent, or Firm*—Fitzpatrick, Cella, Harper & Scinto

[57] ABSTRACT

A belt supporting device includes a first support member for supporting a belt pulley, the member having a smaller width than that of the outer peripheral surface of the pulley, an endless belt wound on the pulley, a second support member for forming between the endless belt wound on the pulley and the second support member a space for extracting the endless belt in the axial direction of the pulley, and a positioning member located movably in and out of the space to maintain the space by entering the space and to thereby position the first and second support members.

12 Claims, 9 Drawing Sheets

BELT SUPPORTING DEVICE AND AUTOMATIC DOCUMENT FEEDING APPARATUS USING THE DEVICE

BACKGROUND OF THE INVENTION

1. Field of the Invention

The present invention relates to a belt supporting device, and an automatic document feeding apparatus and a document reading apparatus using the device.

2. Description of the Related Art

Conventional switching of two members for supporting a belt between a positioned state and a non-positioned state by a simple method, for example, in an automatic document feeding apparatus will now be described with reference to FIG. 7.

FIG. 7 illustrates an automatic document feeding apparatus and an image forming apparatus. In FIG. 7, the automatic document feeding apparatus is divided along two dot chain lines into a document supply section A and a belt conveyor section B. A copying machine body C serving as the image forming apparatus reads a document D laid on a platen (document reading section) 110 by reading means (not shown), forms a toner image to be a transfer image on a photoconductive drum (image forming means) 100, and transfers the transfer image onto a conveyed sheet S, thereby forming an image on the sheet S.

First, the construction of the document supply section A will be described.

A plurality of documents D stacked on a document tray (document holding means) 102 are sequentially delivered from the lowermost one by a semicircular roller 104, separated one by one by a comb-like separating and nipping portion composed of a delivery roller (document feeding means) 103 and a separation belt 106, and conveyed to register rollers 107 and 108*a*, where the document D is registered at its leading end and then conveyed to the belt conveyor section B with a predetermined timing.

The belt conveyor section B is a mechanism that conveys the document D over the platen 110 while pressing a document conveyor belt 116, which is coated with urethane rubber and stretched between a driving roller 111 and a driven roller 112, against the platen 110 by presser rollers 113, 114, and 115.

The document D conveyed from the document supply section A is further conveyed by the document conveyor belt 116, and stopped at a predetermined position on the platen 110. Then, a transfer image corresponding to a document image on the document D is formed on the photoconductive drum 100 in the copying machine body C, transferred onto the sheet S, and fixed by a fixing device (not shown), thereby forming an image on the sheet S.

After that, the document D is conveyed by the document conveyor belt 116 in an opposite direction (to the left in FIG. 7), ejected by eject rollers 108*b* and 109*b*, and returned again to the document tray 102.

The automatic document feeding apparatus having the construction described above has a problem in that the document conveyor belt 116 can be soiled. Toner and pencil lead powders on the document D can transfer onto the document conveyor belt 116 owing to the rubbing of the document D and the document conveyor belt 116, thereby soiling the document conveyor belt 116. This soil can also be copied as images outside an image area and may be found in a copy image, which degrades the quality of print on a copy sheet.

As one measure of solving the above problem, the document conveyor belt 116 is regarded as a part that needs to be periodically replaced, and is replaced with a new belt on the market as needed, while there is a demand for an easier operation of replacing the document conveyor belt 116. Accordingly, a unit-combined structure shown in FIGS. 8 and 9 is adopted to reduce the replacement time.

FIG. 8 is a front view of an automatic document feeding apparatus utilizing the unit-combined structure, and FIG. 9 is a side view showing a stay structure of the automatic document feeding apparatus.

A document supply section A and a belt conveyor section B are fixed to a bottom plate 154 and a coupling plate 153 attached thereto by screws on the rear side of the apparatus. On the front side of the apparatus, the document supply section A is positioned with burrs 150*a* and 150*b* of its front plate 150 engaged with a coupling plate 151, and is fixed by three screws 160.

The belt conveyor section B is also positioned with burrs 152*a* and 152*b* of its front plate 152 engaged with the coupling plate 151, and is fixed by a screw 161. A supporting member 156 for supporting a driven roller 112 generates tension for tightly stretching a document conveyor belt 116 by using a tension spring 157.

In replacing the document conveyor belt 116, the tension spring 157 is first removed, and the supporting member 156 is moved leftward in FIG. 7. Then, the four screws are removed, the coupling plate 151 is detached, and a space is thereby formed between the document supply section A and the belt conveyor section B. Through the space, the document conveyor belt 116 is drawn forward.

In the related art described above, however, there is a need to fix the coupling plate 151 by the plural screws 160 and 161 and to fit all the plural burrs 150*a*, 150*b*, 152*a*, and 152*b* in order to position the coupling plate 151. Therefore, a certain degree of technique is required and a screwdriver is indispensable as a tool, which leads to the following problems:

1) It takes much time to detach the coupling plate 151.

2) Since only a serviceperson can perform the belt replacement, when a user needs to perform replacement, it is difficult to respond quickly to the need.

SUMMARY OF THE INVENTION

Accordingly, it is an object of the present invention to provide a belt supporting device with a simple structure that permits easy loading and unloading of a belt, and more specifically, a positioning device that can easily couple and uncouple two members to be positioned relative to each other, in a short operating time.

In order to achieve the above object, according to an aspect, the present invention provides a belt supporting device including a first support member for supporting a belt pulley, the first support member having a smaller width than that of the outer peripheral surface of the pulley, an endless belt wound on the pulley, a second support member fixed to form between the first support member and the second support member a space for extracting the belt in the axial direction of the pulley therethrough, and a positioning member located movably in and out of the space to maintain the space by entering the space and to thereby position the first and second support members.

Preferably, the positioning member is pivotally supported by a shaft extending in a direction intersecting the axial direction of the pulley.

Preferably, a convex portion and concave portion formed on the first and second support members and the positioning member are engaged when the positioning member is placed in the space.

Preferably, the belt supporting device further includes an actuating lever pivotally supported in a similar manner to the positioning member to be pivoted prior to pivoting of the positioning member in order to widen the space and to permit disengagement of the convex and concave portions.

Preferably, the actuating lever pivots the positioning member in an extracting direction after the convex and concave portions are disengaged.

Preferably, the first and second support members and the positioning member are fastened by a screw.

Preferably, the first support member is a front side plate fixed to a rear side plate by a stay member, and the second support member is fixed to a main body of the device.

Preferably, the endless belt is a document conveyor belt.

The belt supporting device may be applied to an automatic document feeding apparatus including a document tray for holding a document, and feeding means for separating the document on the tray one by one and feeding the document to the endless belt.

The belt supporting device may be applied to a document reading apparatus including a document tray for holding a document, feeding means for separating the document on the tray one by one and feeding the document to the belt, a platen opposing the endless belt to set the document thereon, and reading means for reading the document set on the platen.

According to the construction mentioned above, the first support member and the second support member are positioned by placing the positioning means therebetween, and a space for taking out the belt therethrough is formed by removing the positioning means. Furthermore, the first and second support members are positioned by being engaged with the positioning means by the convex and concave portions. When the two support members are fixed by, for example, a screw in this positioned state, they are put in a coupled state. In this case, the number of screws may be, for example, one, because the screw is used only for fixing.

In releasing from the positioned state the support members fastened by, for example, a screw, the screw is removed, and the actuating member is moved out of the space between the support members. Then, a thick portion of the positioning means opens the support members and disengages the convex and concave portions, and the positioning means is moved to the outside of the support members along with the actuating member. In this state, the first and second support members are spaced at an appropriate interval.

On the other hand, when the positioning means is not placed between the two support members and the support members are not in the positioned state, the support members are positioned by moving the positioning means between the support members with the movement of the actuating member. In this case, first, the space between the support members is widened by placing the thick portion of the actuating member between the support members. When the positioning means enters between the support members in this widened state and the thick portion comes out of the space between the support members, the convex and concave portions are respectively fitted, and the space between the first and second support members and the positions thereof in the direction of their positioning surfaces are easily set.

In the automatic document feeding apparatus utilizing the positioning device described above, since the first and second support members are uncoupled only by moving the actuating member of the positioning means outside the support members, belt replacement can be easily performed not only by a serviceperson, but also by a user.

As mentioned above, according to the present invention, two support members can be easily coupled and uncoupled by a user without the need for an operation by a serviceperson, and the operation time can be markedly reduced.

Furthermore, when the first and second support members and the positioning means are fixed by a screw in a positioned state, the screw does not need to work for positioning. Therefore, a plurality of screws are unnecessary, and it is possible to substantially reduce the number of fixing screws, or to use a clamp or the like instead of such fixing screws. As a result, it is possible to obtain the advantages of a shorter operation time, cost reduction, and a simple operation.

Further objects, features and advantages of the present invention will become apparent from the following description of the preferred embodiments with reference to the attached drawings.

DESCRIPTION OF THE PREFERRED EMBODIMENT

Figure 7:
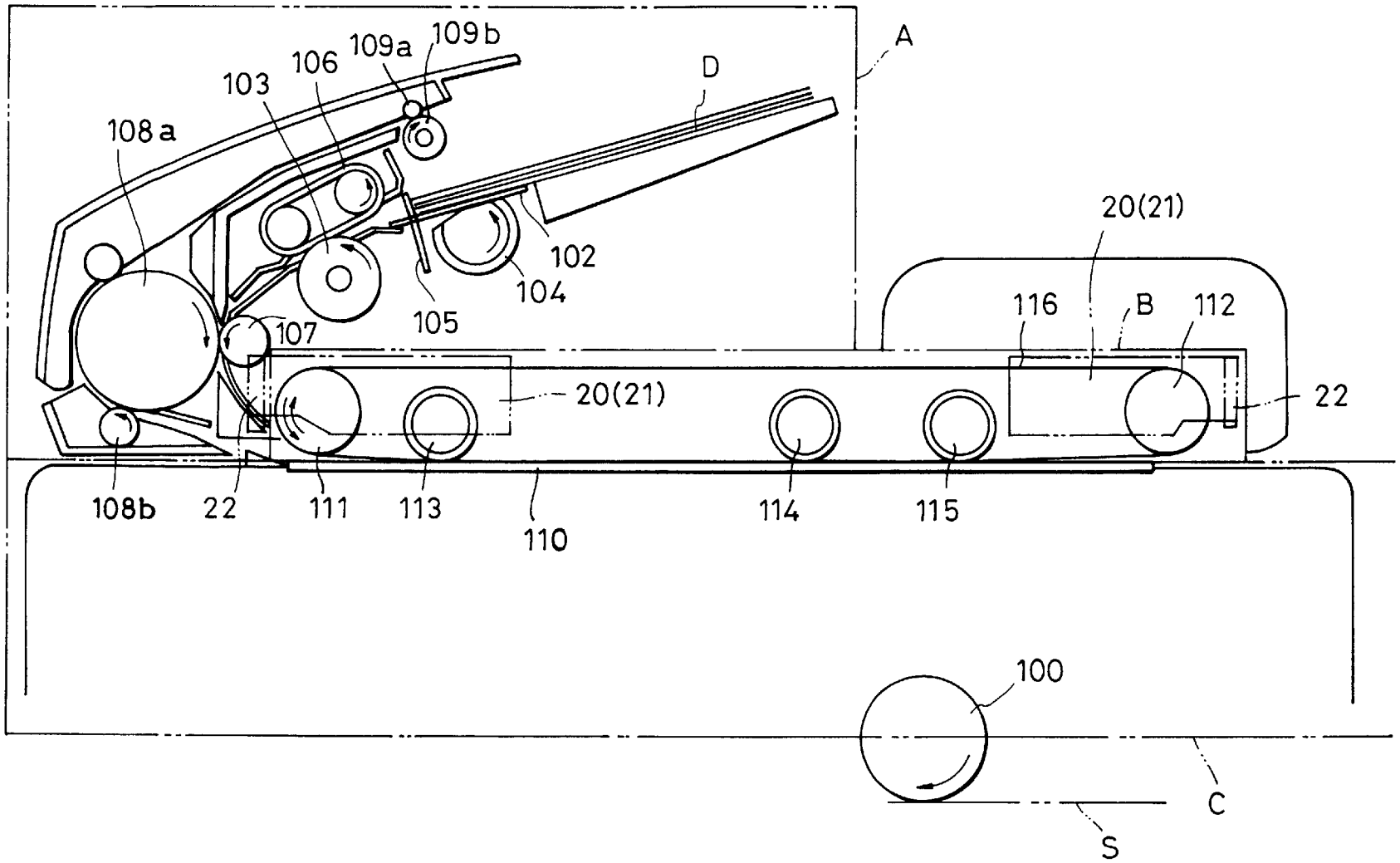
FIG. 7 is a front view of an automatic document feeding apparatus and an image forming apparatus to which the positioning device of the present invention is applicable.
Figure 8:
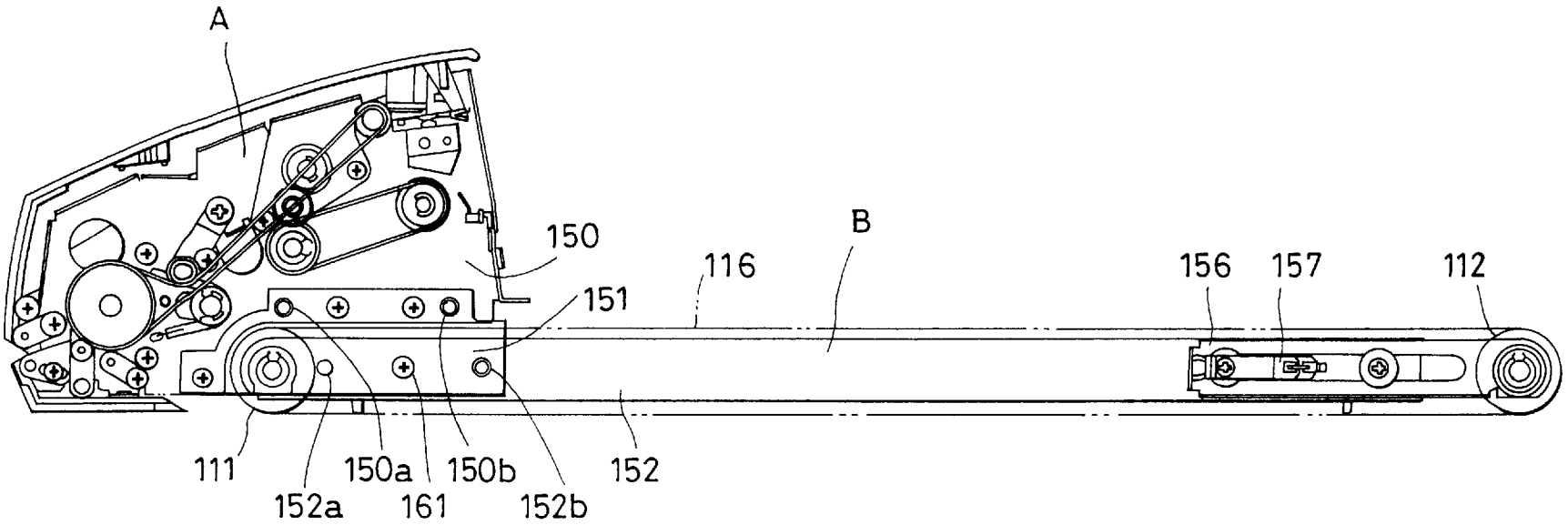
FIG. 8 RELATED ART
FIG. 8 is a front view of an automatic document feeding apparatus to which a conventional positioning device is applied.
Figure 9A:
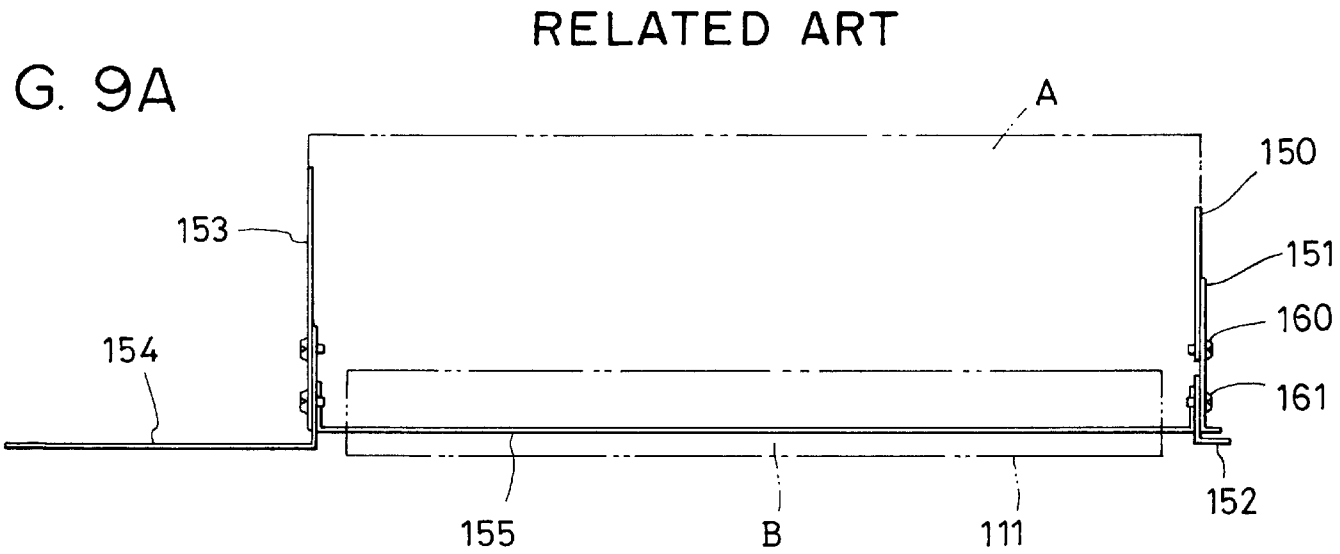
RELATED ART FIG. 9A
FIGS. 9A and 9B are side and operational views of the apparatus shown in FIG. 8.
Figure 9B:
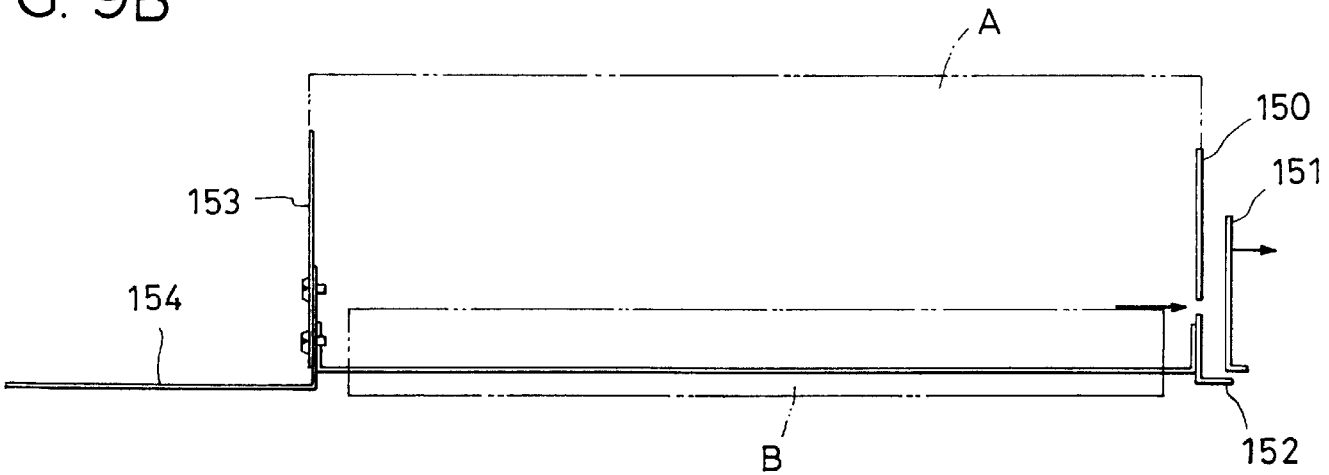

A positioning device serving as a belt supporting device according to an embodiment of the present invention will be described below with reference to FIGS. 1 to 6. As an automatic document feeding apparatus and an image forming apparatus to which the positioning device of the present invention applies, the apparatuses shown in FIGS. 7 and 8, which have been mentioned in connection with the related art, are quoted, and a detailed description thereof is omitted.

Figure 1:
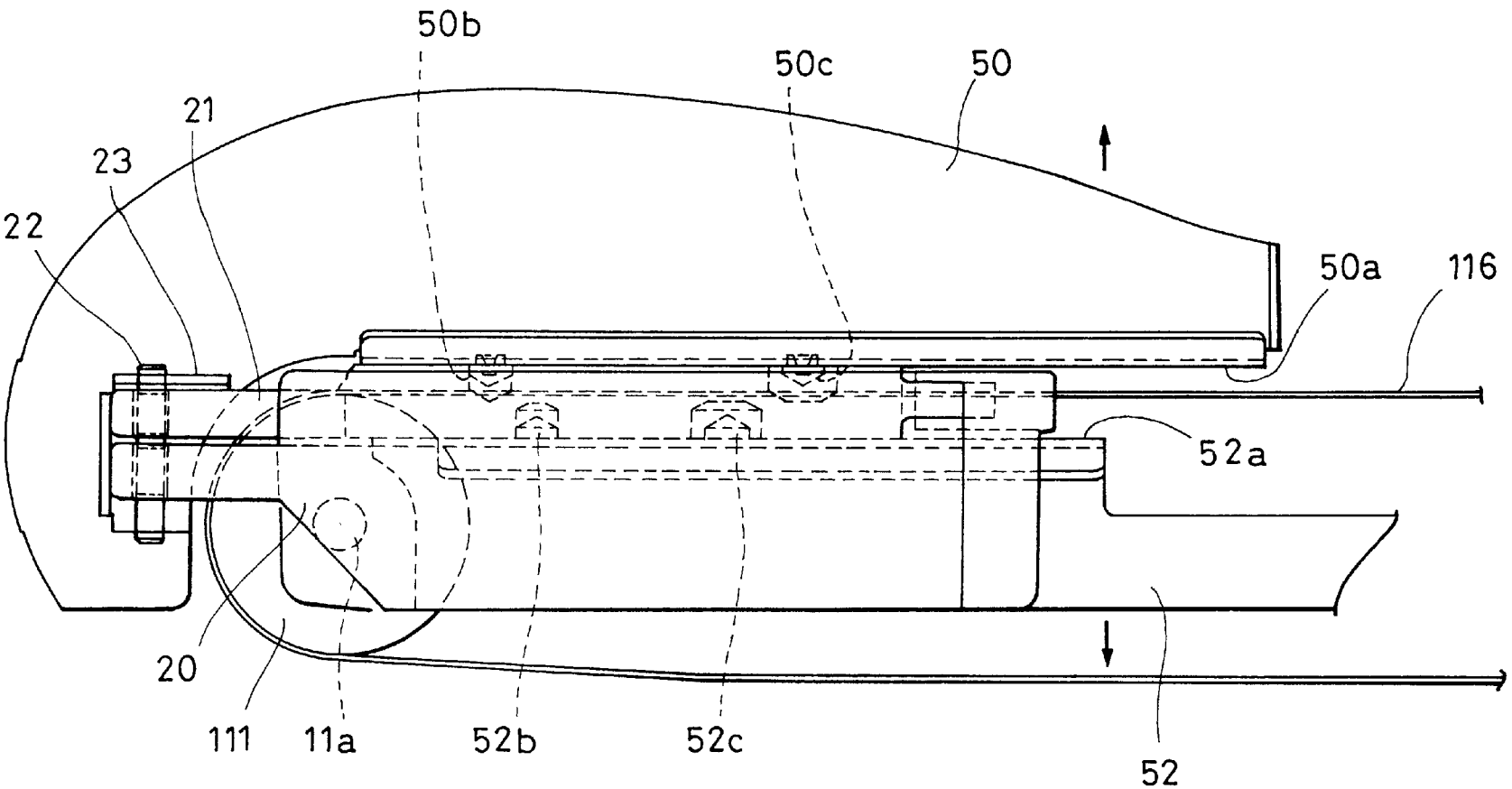
FIG. 1 is a front view of a positioning device according to the present invention.
Figure 2:
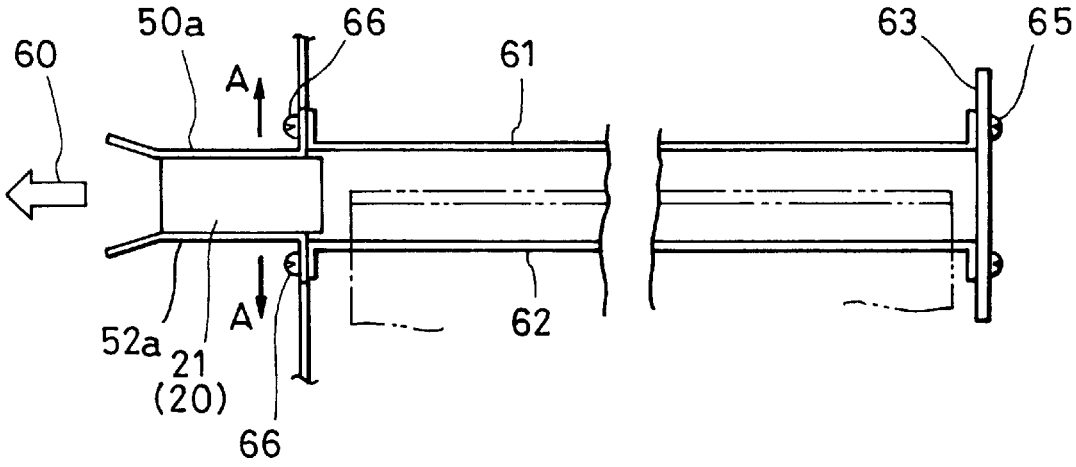
FIG. 2 is a side view of the positioning device shown in FIG. 1.

The positioning device of this embodiment is an improvement in a peripheral section of the coupling plate of the conventional automatic document feeding apparatus mentioned above. FIG. 1 is a front view of the positioning device, and FIG. 2 is a right side view of the principal part of the positioning device shown in FIG. 1. FIGS. 3 to 6 are plan and side views of the positioning device which illustrate the coupling state of the device. While two belt supporting devices are supported by shafts 22 and symmetrically placed on the right and left sides in the present invention, as shown in FIG. 7, since their constructions are the same except that they are in an inverse relation, a description will now be given of only the left belt supporting device.

In FIGS. 1 to 6, numeral 50 denotes a supply side plate of a document supply section A (FIG. 8) serving as a first support member, and numeral 52 denotes a front side plate of a belt conveyor section B (FIG. 8) serving as a second support member. A first positioning surface 50*a* that is a horizontal surface of the supply side plate 50 and a second positioning surface 52*a* that is a horizontal surface of the front side plate 52 are opposed almost in parallel at an appropriate interval, as shown in FIG. 2.

Referring to FIG. 2, the supply side plate 50 is fixed by a screw 66 to a free end of a first stay 61 having elasticity, and the front side plate 52 is fixed by a screw 66 to a free end of a second stay 62 having elasticity. The supply side plate 50 is also fixed to the main body of the apparatus.

The first and second stays 61 and 62 are fixed at the bases to a side plate 63, which is placed on the inner side of the apparatus, by screws 65 so as to hold the supply side plate 50 and the front side plate 52 still in predetermined positions defined by a positioning plate 21. When the supply side plate 50 and the front side plate 52 are opened by an actuating lever 20 in the directions of arrows A as will be described later, they are urged by the elastic force of the first and second stays 61 and 62 so as to return to their initial predetermined positions.

Figure 5A:
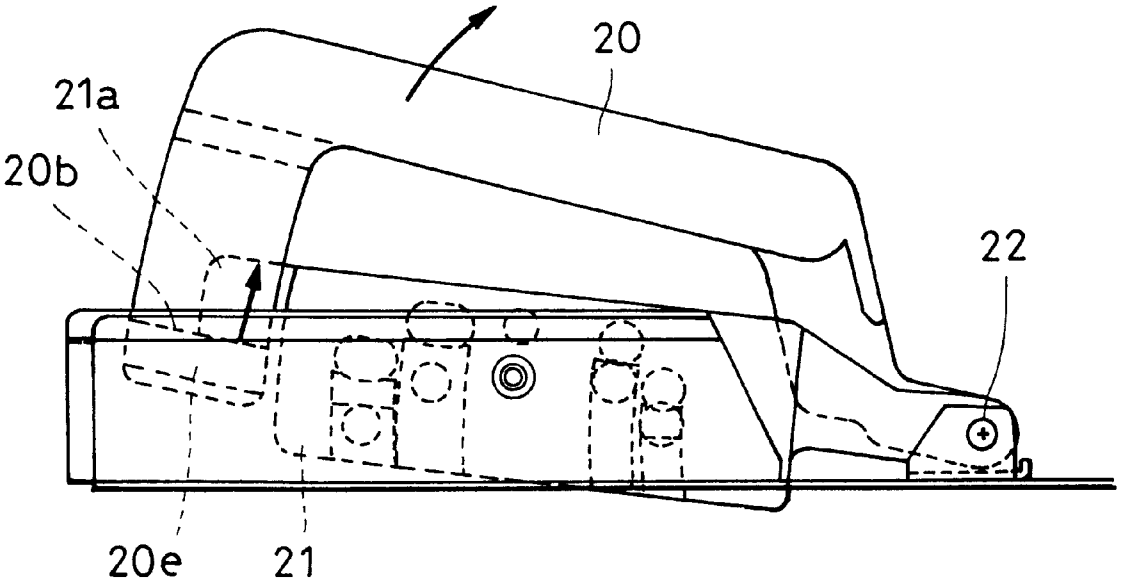
FIGS. 5A and 5B are plan and side views showing the operation of the positioning device.
Figure 5B:
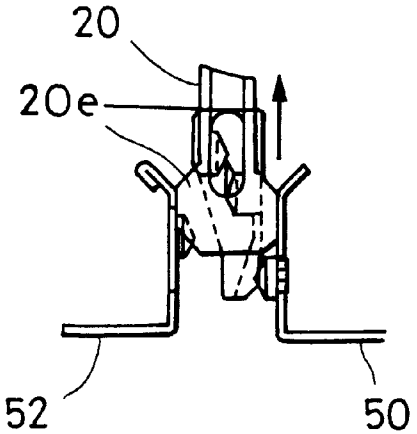
Figures 6A, 6B:
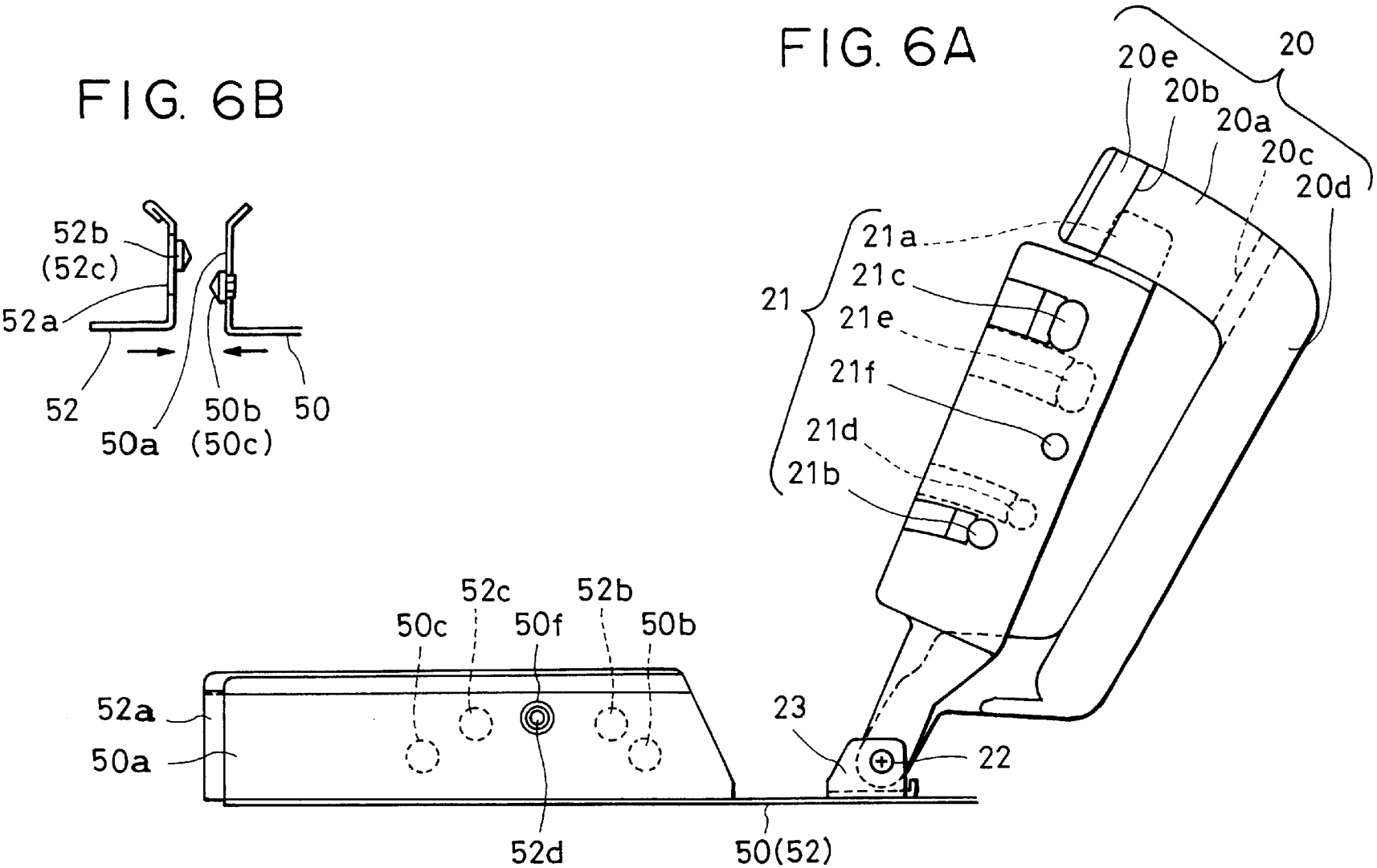
FIGS. 6A and 6B are plan and side views showing the operation of the positioning device.

In the state in which the positioning plate 21 has been drawn out of the supply side plate 50 and the front side plate 52 in the direction of arrow 60 through the process shown in FIGS. 3 to 6, a space is formed between the first positioning surface 50*a* and the second positioning surface 52*a*, as shown in FIG. 6B, and a document conveyor belt 116 is allowed to be extracted in the same direction and to be detached from the apparatus. This document conveyor belt 116 is tightly wound on a driving roller 111 and a driven roller 112. A shaft 11*a* of the driving roller 111 is rotatably supported by the front side plate 52 at one end, and is supported by the side plate 63 at the other end.

Between the supply side plate 50 and the front side plate 52, the actuating lever (operating member) 20 and the positioning plate (positioning means) 21 are located rotatably about a support shaft 22 of a support plate 23 that is attached to the supply side plate 50. The supply side plate 50 and the front side plate 52 are coupled by screws via the positioning plate 21. The front side plate 52 is fixed.

An arm section formed at the free end of the actuating lever 20 is provided with an engaging hole 20*a* in which an engaging portion 21*a* of the positioning plate 21 is fitted. When the actuating lever 20 is turned counterclockwise under the control of the user, the engaging portion 21*a* of the positioning plate 21 engages with a left wall 20*c* of the engaging hole 20*a*. When the actuating lever 20 is turned clockwise, the engaging portion 21*a* engages with a right wall 20*b*, and the positioning plate 21 is thereby turned along with the actuating lever 20.

A thick portion 20*e* formed at the end of the arm section of the actuating lever 20 has a larger thickness than that of the positioning plate 21, and can be drawn in and out between the supply side plate 50 and the front side plate 52.

Figure 3A:
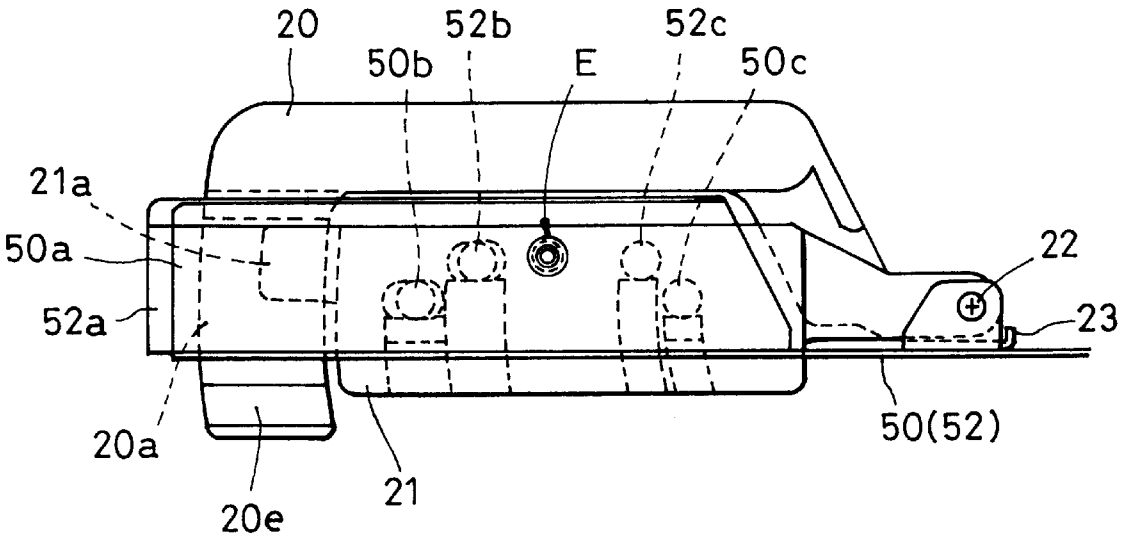
FIGS. 3A and 3B are plan and side views of the positioning device.
Figure 3B:
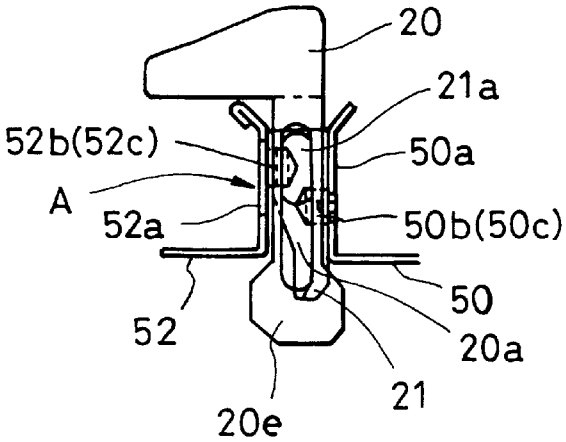

FIGS. 3A and 3B show a state in which the supply side plate 50 and the front side plate 52 are coupled to each other. The supply side plate 50 and the front side plate 52 are uncoupled by the operations shown in FIGS. 4A to 6B.

First positioning shafts 50*b* and 50*c* stand on the first positioning surface 50*a* in a standing manner, and second positioning shafts 52*b* and 52*c* stand on the second positioning surface 52*a* in a standing manner. The positioning plate 21 is provided with first positioning holes 21*b* and 21*c* to fit on the first positioning shafts 50*b* and 50*c*, and second positioning holes 21*d* and 21*e* to fit on the second positioning shafts 52*b* and 52*c*.

The first positioning shafts 50*b* and 50*c* and the first positioning holes 21*b* and 21*c* constitute a first fitting means, and the second positioning shafts 52*b* and 52*c* and the second positioning holes 21*d* and 21*e* constitute a second fitting means.

In the state in which the supply side plate 50 and the front side plate 52 are coupled to each other, the first positioning shafts 50*b* and 50*c* are fitted in the first positioning holes 21*b* and 21*c*, and the second positioning shafts 52*b* and 52*c* are fitted in the second positioning holes 21*d* and 21*e*.

FIGS. 3A and 3B show the coupled state of the supply side plate 50 and the front side plate 52. In FIG. 3A, E indicates a screw position of a wing screw (not shown) for fixing the supply side plate 50, the positioning plate 21, and the front side plate 52.

As shown in FIG. 6A, the first positioning surface 50*a* of the supply side plate 50 and the positioning plate 21 are provided with a through hole 50*f* and a through hole 21*f*, respectively, corresponding to the position E. The second positioning surface 52*a* is provided with a tap 52*d* corresponding to the position E. In the coupled state, the supply side plate 50, the positioning plate 21, and the front side plate 52 are screwed and fixed by the wing screw at this position E.

An operation of uncoupling the supply side plate 50 and the front side plate 52 will now be described with reference to the drawings.

Figure 4A:
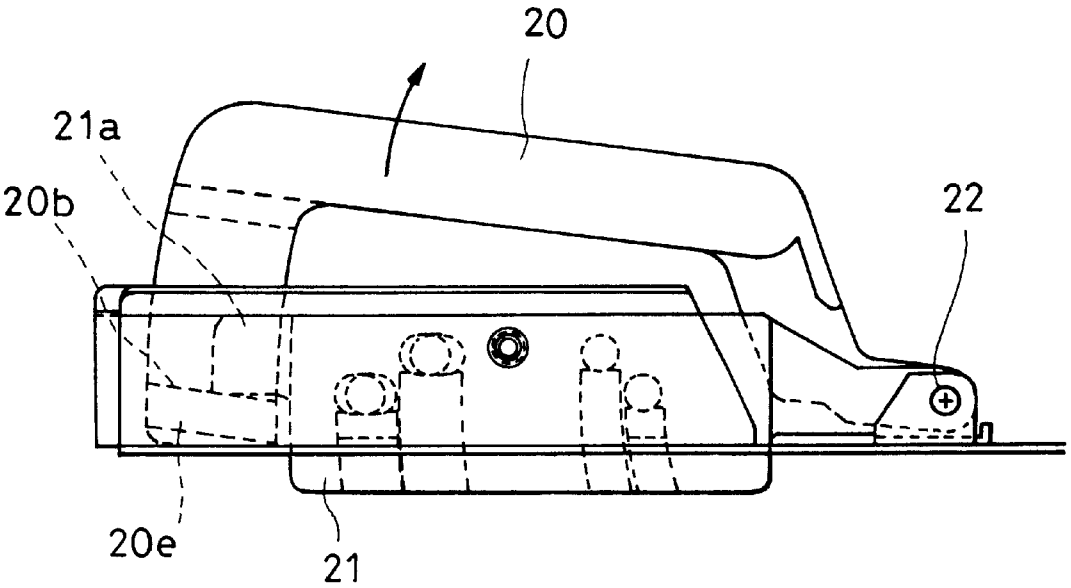
FIGS. 4A and 4B are plan and side views showing the operation of the positioning device.
Figure 4B:
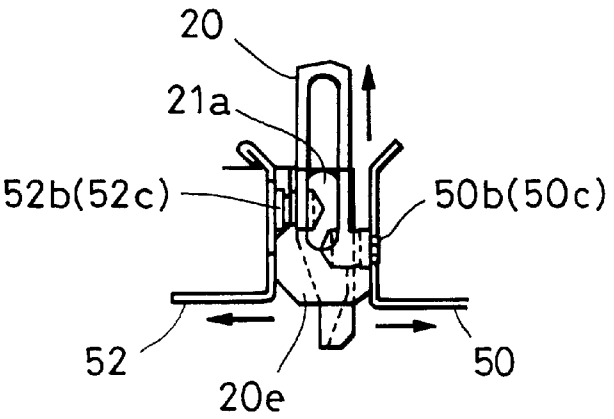

First, the actuating lever 20 is freed by removing the wing screw at the screw position E, and turned clockwise (toward the front side of the apparatus), as shown in FIG. 4A. Then, the thick portion 20*e* of the actuating lever 20 enters between the first positioning surface 50*a* of the supply side plate 50 and the second positioning surface 52*a* of the front side plate 52, as shown in FIG. 4B. Since the front side plate 52 of the belt conveyor section B is supported only on the inner side of the apparatus in a cantilevered manner, it is pressed by the thick portion 20*a* of the actuating lever 20, and moved downward in FIG. 1. The first positioning surface 50*a* of the supply side plate 50 is bent upward.

Thereby, the first positioning shafts 50*b* and 50*c* and the second positioning shafts 52*b* and 52*c* are disengaged from the holes 21*b* to 21*e* of the positioning plate 21, so that the positioning plate 21 is allowed to turn. When the actuating lever 20 is further turned clockwise as shown in FIGS. 5A and 5B, the right wall 20*b* of the engaging hole 20*a* engages with the engaging portion 21*a* of the positioning plate 21, and the positioning plate 21 is also turned clockwise into an uncoupled state shown in FIG. 6A. In this state, a space for drawing the document conveyor belt 116 (shown in FIGS. 1 and 7) forward therethrough is secured between the supply side plate 50 and the front side plate 52, as shown in FIG. 6B.

Conversely, an operation of switching from the uncoupled state to the coupled state is performed as follows.

After the document conveyor belt 116 is loaded, the actuating lever 20 is turned counterclockwise from the uncoupled position shown in FIG. 6A. Then, the engaging portion 21*a* of the positioning plate 21 makes contact with the left wall 20*c* of the actuating lever 20, and the positioning plate 21 is also turned counterclockwise.

The thick portion 20*e* of the actuating lever 20 first enters between the positioning surfaces 50*a* and 52*a* of the supply side plate 50 and the front side plate 52, thereby widening the space between the positioning surfaces 50*a* and 52*a*.

When the space between the positioning surfaces 50*a* and 52*a* is widened, the positioning plate 21 also enters between the positioning surfaces 50*a* and 52*a*. When the first positioning holes 21*b* and 21*c* and the second positioning holes 21*d* and 21*e* come near the corresponding first and second positioning shafts 50*b*, 50*c*, 52*b*, and 52*c*, the thick portion 20*e* of the actuating lever 20 comes out of the space between the positioning surfaces 50*a* and 52*a*, thereby narrowing the space.

The first positioning shafts 50*b* and 50*c* and the second positioning shafts 52*b* and 52*c* are fitted in the first positioning holes 21*b* and 21*c* and the second positioning holes 21*d* and 21*e* of the positioning plate 21, respectively, along tapered portions thereof, whereby the supply side plate 50, the positioning plate 21, and the front side plate 52 are put into a coupled state.

Finally, the coupling operation is completed by fastening the supply side plate 50 and the front side plate 52 serving as the first and second members by a wing screw that is not shown.

The application of the positioning device having the above-mentioned construction to the document supply section A and the belt conveyor section B in order to put the supply side plate 50 and the front side plate 52 into and out of place makes it possible for the user to easily replace the document conveyor belt 116 through the space formed between the supply side plate 50 and the front side plate 52 without the need for the operation by the serviceperson.

The supply side plate 50, the front side plate 52, and the positioning plate 21 may be linked without using the aforesaid wing screw, for example, they may be fixed only by pressing the supply side plate 50 and the front side plate 52 from above and below with a click mechanism or the like, which can eliminate the necessity for the wing screw or a screwdriver for turning screws or the like.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A belt supporting device, comprising:

a first support member for supporting a belt pulley, said first support member having a smaller width than that of the outer peripheral surface of said pulley;

an endless belt wound on said pulley;

a second support member for forming between said endless belt wound on said pulley and said second support member a space for extracting said endless belt in the axial direction of said pulley; and a positioning member located movably in and out of the space to maintain the space by entering the space and to thereby position said first and second support members.

2. A belt supporting device according to claim 1, wherein said positioning member is pivotally supported by a shaft extending in a direction intersecting the axial direction of said pulley.

3. A belt supporting device according to claim 2, wherein a convex portion and a concave portion formed on said first and second support members and said positioning member are engaged when said positioning member is placed in the space.

4. A belt supporting device according to claim 3, further comprising:

an actuating lever pivotally supported to said positioning member to be pivoted prior to pivoting of said positioning member in order to widen the space and to permit disengagement of said convex and concave portions.

5. A belt supporting device according to claim 4, wherein said actuating lever pivots said positioning member in an extracting direction after said convex and concave portions are disengaged.

6. A belt supporting device according to claim 5, wherein said first and second support members and said positioning member are fastened by a screw.

7. A belt supporting device according to claim 1, wherein said first support member is a front side plate fixed to a rear side plate by a stay member.

8. A belt supporting device according to claim 7, wherein said second support member is fixed to a main body of said device.

9. A belt supporting device according to claim 1, wherein said endless belt is wound on a pair of right and left pulleys and said first support member, said second support member, and said positioning means are each provided in a pair.

10. A belt supporting device according to one of claims 1 to 9, wherein said endless belt is a document conveyor belt.

11. An automatic document feeding apparatus, comprising:

a belt supporting device according to claim 1;

a document tray for holding a document; and feeding means for separating the document on said document tray one by one and feeding the document to said endless belt in said belt supporting device.

12. A document reading apparatus, comprising:

a belt supporting device according to claim 1;

a document tray for holding a document;

feeding means for separating the document on said document tray one by one and feeding the document to said endless belt in said belt supporting device;

a platen opposing said endless belt to set the document thereon; and reading means for reading the document set on said platen.

* * * * *

UNITED STATES PATENT AND TRADEMARK OFFICE

CERTIFICATE OF CORRECTION

PATENT NO. : 6,113,095

DATED : September 5, 2000

INVENTOR(S): HARUO NARUSE

It is certified that error appears in the above-identified patent and that said Letters Patent is hereby corrected as shown below:

COVER PAGE AT ITEM [56] RC:
Foreign Patent Documents: "04020441" should read --4-20441--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*